US007385702B2

(12) United States Patent
Schaede

(10) Patent No.: US 7,385,702 B2
(45) Date of Patent: Jun. 10, 2008

(54) PROCESS AND APPARATUS TO CONTROL THE INTEGRITY OF A PLANAR SUBSTRATE

(75) Inventor: Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 106 days.

(21) Appl. No.: 10/537,122

(22) PCT Filed: Dec. 5, 2003

(86) PCT No.: PCT/IB03/05790

§ 371 (c)(1),
(2), (4) Date: Dec. 6, 2005

(87) PCT Pub. No.: WO2004/054909

PCT Pub. Date: Jul. 1, 2004

(65) Prior Publication Data

US 2006/0145102 A1 Jul. 6, 2006

(30) Foreign Application Priority Data

Dec. 13, 2002 (EP) ..... 02027696

(51) Int. Cl.
*G01N 21/84* (2006.01)

(52) U.S. Cl. ..... 356/429; 356/431

(58) Field of Classification Search ..... None
See application file for complete search history.

(56) References Cited

U.S. PATENT DOCUMENTS 4,623,975 A 11/1986 Kagami
5,443,257 A * 8/1995 Sakamori ..... 271/228

FOREIGN PATENT DOCUMENTS

EP 0 317 655 A1 5/1989
JP 59212345 12/1984

* cited by examiner

*Primary Examiner*—Michael P. Stafira
(74) *Attorney, Agent, or Firm*—Crompton, Seager & Tufte, LLC

(57) ABSTRACT

The process comprises the following steps: detection of the passage of an edge of the substrate by a first trigger, detection of the passage of said edge of the substrate at least at a first selected checkpoint on the substrate; control of the presence of the detection of the edge of the substrate at said at least first checkpoint between said detection by said triggers and generation of an integrity check failed message in the absence of the detection of the edge of the substrate at said checkpoint.

11 Claims, 4 Drawing Sheets

PROCESS AND APPARATUS TO CONTROL THE INTEGRITY OF A PLANAR SUBSTRATE

FIELD OF THE INVENTION

The present invention concerns a process to control the integrity of a planar substrate, for example sheets of paper for securities.

The present invention also concerns a device suitable for carrying out the process according to the invention.

BACKGROUND OF THE INVENTION

In the field of printing machines, in particular for securities such a banknotes, checks and other similar printed matter, many quality controls are carried out during the entire printing process. Indeed, it is very important to ensure a high quality of production, especially in the field of securities, and hence the precise controls. Such controls can take the form of a check of the quality of the printing, of the recto-verso register of prints on the sheet of substrate etc. It is of course also necessary to control the shape of the substrate, i.e. to check that the substrate, for example a paper substrate, is not torn or folded.

In known methods and devices of the prior art, the quality control of a paper substrate during the printing process is made by a tactile process by contacting the entire surface of the sheet of paper. Such a method has several drawbacks, i.e. the fact that it contacts the substrate and also the fact that is has to be able to follow the speed of the sheets being controlled. Moreover, a direct contact with the substrate may mark or damage said substrate, causing defects in the printing process.

Other devices use photocells to control the sheet edge, said cells being triggered by the machine. They are thus speed and paper size dependent.

SUMMARY OF THE INVENTION

It is therefore an aim of the invention to improve the known methods of control and machines able to carry out said methods.

More specifically, an aim of the invention is to provide a simple method to control the integrity of planar substrates, such as sheets of paper which is independent from speed and paper size.

Another aim of the invention is to provide a simple and effective machine to check the integrity of planar such as sheets of paper.

BRIEF DESCRIPTION OF THE DRAWINGS

The invention is characterised by the features defined in the claims.

Further characterizing features and advantages of the present invention will become apparent from the following detailed description, given by way of non-limitative examples, and illustrated by the accompanying drawings, in which.

DETAILED DESCRIPTION OF THE EMBODIMENTS

Figure 1:
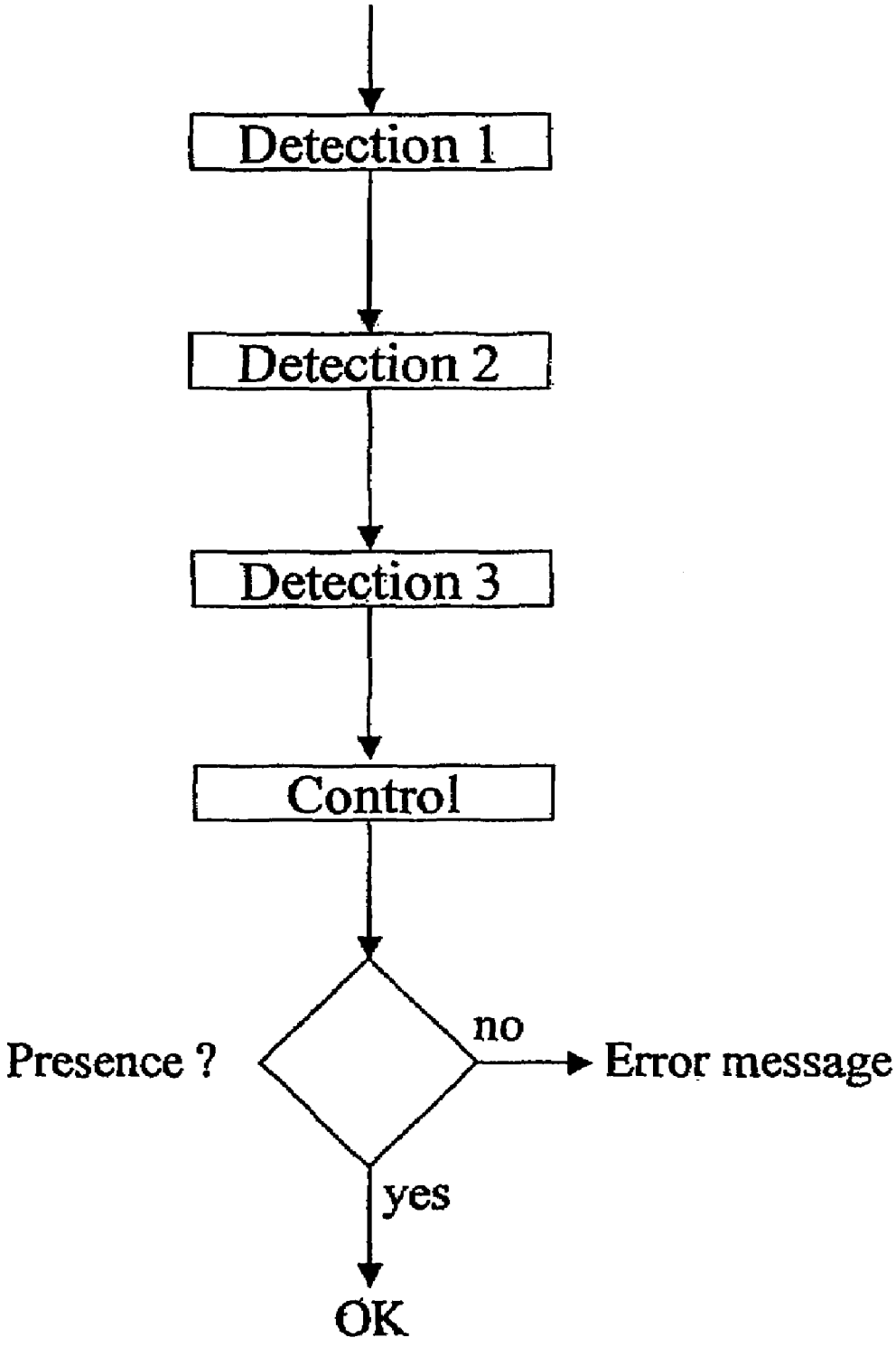
FIG. 1 shows a bloc-diagram of the process according to the invention.

The bloc-diagram of FIG. 1 discloses the steps of the process according to the invention and applied to a planar substrate being controlled.

As the first step, a first detection is carried out, namely a detection of the passage of an edge of the substrate by a first trigger. This first step can be used to activate the process of detection by a trigger signal. Then, the second step includes the detection of the passage of the edge of the substrate at least at a first selected checkpoint on the substrate issuing a first checkpoint signal. Preferably, since it is the corners of the sheet of substrate that are usually torn or folded, the at least one checkpoint is preferably situated close to a corner of the substrate. Most preferably, because a planar substrate carries four corners (two at the leading edge and two at the trailing edge), one uses two checkpoints placed in the area of the corners of the substrate, on each side of the transporting direction of the substrate.

Then, a third detection is carried out by a second trigger of the passage of the edge of the substrate that has been detected in the first step, the detection of this trigger signal terminating in principle the detection steps of the process.

After that, there is a control of the presence of the detection of the edge of the substrate at said at least first checkpoint between said detection by said triggers by using the above-mentioned issued signals. Indeed, an idea of the process is to detect the passage of the edge of the substrate at one or more selected checkpoints between the detection of triggers or at least after the detection of a first trigger. Preferably, as indicated above, the checkpoint or checkpoints are selected to be placed where the substrate has the most probably a defect (in corners) and the trigger (or triggers) is (are) placed where the substrate has the least probably a defect.

If the detection signal of the checkpoint or checkpoints has not given any result, i.e. if a checkpoint has not emitted a change signal after a first trigger signal or between the detection of both trigger signals or a checkpoint signal is detected after or before said first trigger signal, then there is the generation of an integrity check failed message ("error message" in FIG. 1). If the checkpoint or checkpoints signals have been properly detected, that is in the proper order after the first trigger signal, and before the second trigger if any, then there is an OK message.

The detection process according to the invention is further described with reference to FIG. 2 in which a substrate 1, for example a sheet, in movement in the direction of the arrow, passes under a detection device according to the invention. The detection device comprises a first trigger 2, a second trigger 5 and checkpoints 3, 4. For the sake of simplicity, a detection device is represented schematically on the leading edge 6 of the sheet 1 and also on the trailing edge 7 of the sheet. It is clear however that only one detection device is sufficient to carry out the process of the invention for both edges when the substrate is being transported in the direction of the arrow and explanations will be given for the leading edge 6 first. Further, it is also possible to use more than two checkpoints, for example a row of a plurality of checkpoints able to control the entire width of the sheet, the embodiment of FIG. 2 being only used as a non-limiting example.

If, for example, the left corner 8 of the substrate is folded or is missing, the first trigger 2 will detect the leading edge 6 and output a first trigger signal, checkpoint 3 will detect the leading edge 6 and output a corresponding checkpoint signal, and then second trigger 5 will detect the leading edge and output another trigger signal. A second checkpoint detection signal will be missing, or arrive a certain time after the detection of the second trigger 5 signal, indicating the passage of the leading edge 6 in the area of the second checkpoint, thus generating an error message, because the detection of the checkpoint signal was not made between the two triggers 2 and 5 signals.

Figure 2:
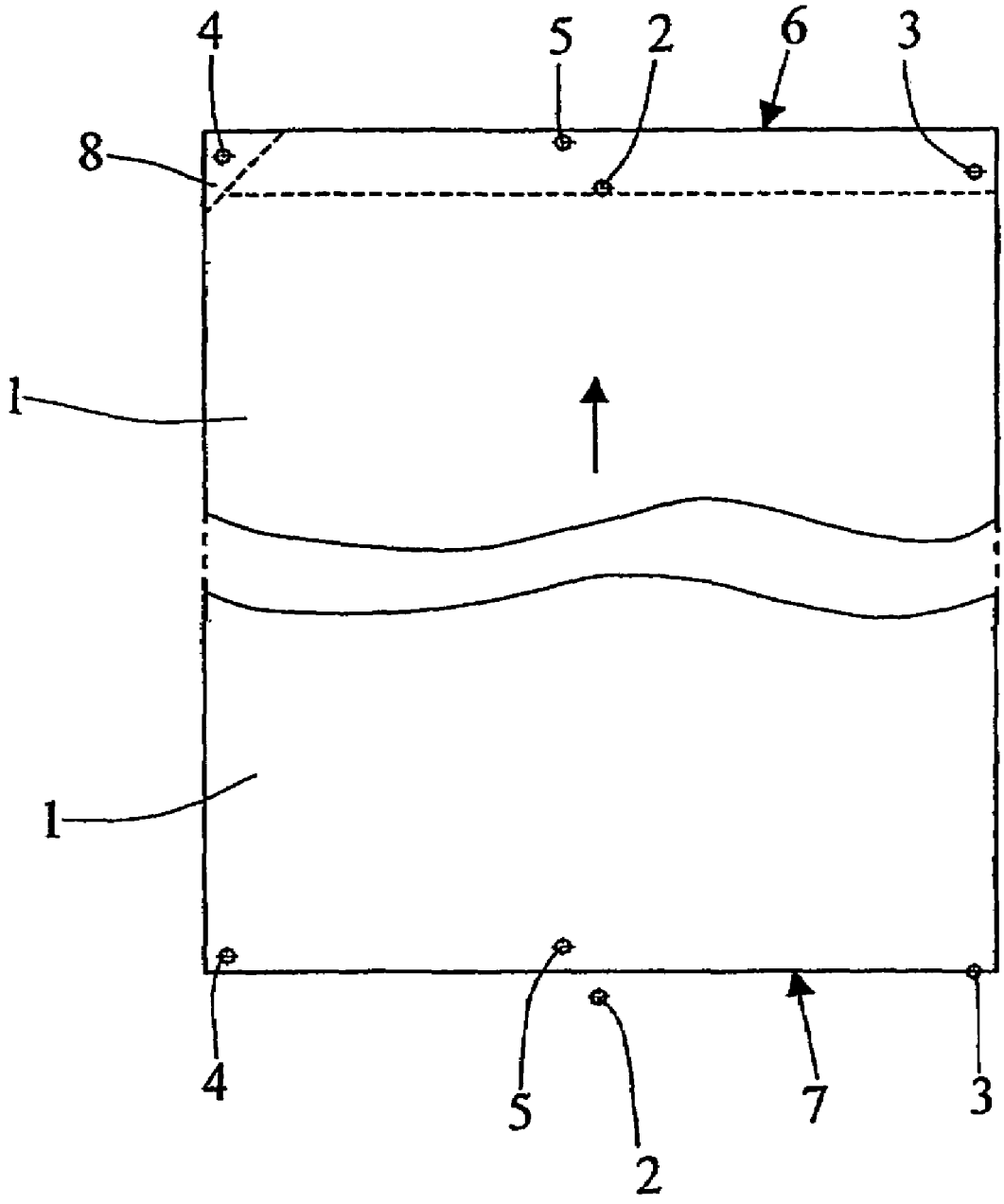
FIG. 2 shows schematically a control of a substrate, such as a sheet.

The same integrity check may be applied to the trailing edge 7 of the substrate 1, as schematically represented in FIG. 2. With the substrate 1 being transported, in the direction of the arrow, the trailing edge 7 of the substrate reaches the trigger 2 first. This trigger 2 hence detects a change in the background, for example from a clear background to a dark background, and initiates the control process with a trigger signal.

Because of its displacement, the trailing edge 7 of the substrate 1 reaches then checkpoint 3 which detects the change in the background, for example from a clear background to a dark background with optical means and outputs a first checkpoint signal. The substrate 1 still being displaced, the trailing edge 7 passes checkpoint 4 where a change in the background is also detected (for example from a clear background to a dark background with optical means) and a second checkpoint signal is output. Finally, trailing edge 7 passes second trigger 5, again detecting a change in the background whereby the detection is terminated at least temporarily by a second trigger signal.

As for the leading edge 6, by knowing the speed of the substrate and the relative position of triggers 2, 5 and checkpoints 3, 4, in the direction of motion of the substrate, it is in addition possible to determine the timing sequence of detection of the checkpoint 3, 4 signals relative to the trigger signals. Any absence of a checkpoint signal detection between the two triggers 2, 5 signals or detection of a checkpoint signal after the second trigger 5 signal, or even absence of detection of a checkpoint signal indicates a defect in the substrate, for example a damaged corner.

The distance, in the direction of movement of the substrate 1, between the different detection points (triggers 2, 5 and checkpoints 3, 4) may be varied or adjusted to increase the speed of detection.

Figure 3:
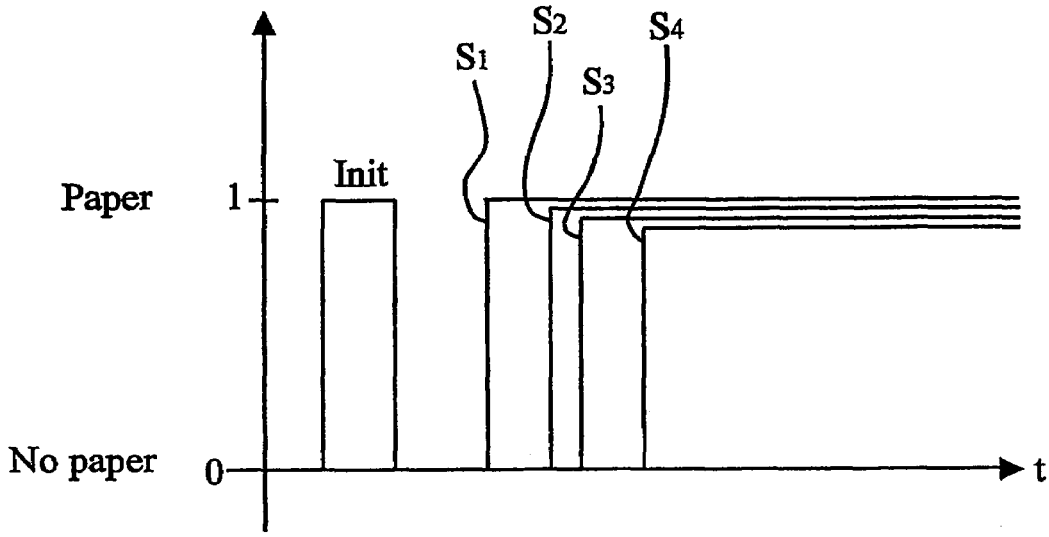
FIG. 3 shows a diagram of detection for the leading edge of a substrate.
Figure 4:
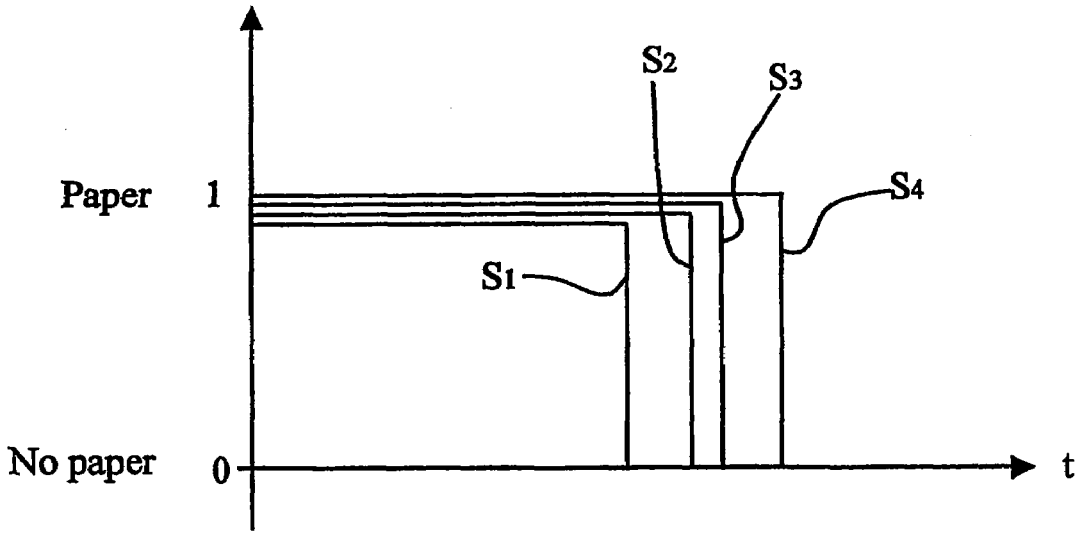
FIG. 4 shows a diagram of detection for the trailing edge of a substrate.

The process according to the invention is explained in a more detailed manner with reference to FIGS. 2 to 4, in which an optional second trigger 5 is used. The planar substrate 1 being transported in the direction of the arrow, the leading edge 6 reaches trigger 2 first of the fixed detection device as schematically represented by the dashed line perpendicular to the directions of transportation in FIG. 2. Thus, trigger 2, for example realised by an optical detector, detects a change in the background, for example but not limited thereto, a passage from black (background without substrate) to white (substrate in the background), i.e "no paper" to "paper" which initiates the detection process by outputting a trigger signal S1. This detected change is represented in FIG. 3 by the passage from "no paper" to "paper" of S1. With the substrate 1 moving, another detection is carried out at checkpoints 3 and 4, which are placed close to opposite corners of the substrate, but are offset with respect to each other in the direction of movement of the substrate 1, in order to be able to distinctly detect the leading edge 6 of the substrate 1 passing one checkpoint after the other, for example checkpoint 3 and then checkpoint 4, if checkpoint 3 is closer to trigger 2 in the direction of motion of the substrate 1. The detection principle is similar to the one carried out for trigger 2, for example by detecting optically a change in the background from dark to clear (black to white), i.e. "no paper" to "paper", the aim being to be able to detect the passage of the edge of the substrate in the corners covered by checkpoints 3 and 4 and two checkpoint signals S2, S3 are output. This detection is represented in FIG. 3 by the changes in S2 and S3, illustrating a passage from "no paper" to "paper".

If the trigger 2 detects a change from "no paper" to "paper" but one of the checkpoints, or even both, has already output a signal change from "no paper" to "paper", then the sheet area controlled must be considered defective. This may be represented by the Boolean operation $S1 \wedge \overline{S2} \wedge \overline{S3} = \neg(\overline{S1} \wedge S2 \wedge S3)$ Finally, with the substrate still in movement with respect to the detection device, the leading edge 6 of the substrate 1 reaches second trigger 5 that reacts in the same manner as first trigger 2, by detection of a change in the background (dark to clear for example) i.e. "no paper" to "paper", outputs a second trigger signal S4 and the control process can be ended. This detected change is represented in FIG. 3 by the change in S4, i.e. passage from "no paper" to "paper".

If the trigger signal S4 changes from "no paper" to "paper" and one of the checkpoint signals S2, S3 has not changed from "no paper" to "paper", then the sheet area has to be considered defective (for example hole, missing edge etc): this may be represented by the Boolean operation $\overline{S4} \wedge S2 \wedge S3 = \neg(S4 \wedge \overline{S2} \wedge \overline{S3})$.

For the trailing edge of the substrate, reference is now made specifically to FIGS. 2 and 4. Trigger 2 first detects the passage of the edge of the substrate and changes from "paper" to "no paper", this change being represented by trigger signal S1 in FIG. 4. After the detection by the first trigger, first checkpoint 3 and then second checkpoint 4 have to output a signal, respectively S2 and S3 to indicate the passage of the trailing edge, i.e. a passage from "paper" to "no paper".

If the trigger signal S1 changes from "paper" to "no paper" and one of the checkpoints 3, 4 signals has already changed from "paper" to "no paper" (signals S2 or S3 in FIG. 4), then the substrate area has to be considered defective (for example missing edge, crease) and this may be represented by the Boolean operation $\overline{S1} \wedge S2 \wedge S3 = \neg(S1 \wedge S2 \wedge \overline{S3})$.

The trigger 5 finally detects the end of the sheet edge, hence the end of monitoring. If this trigger 5 signal changes from "paper" to "no paper" (signal S4 in FIG. 4) and one of the checkpoints 3, 4 signals has not changed from "paper" to "no paper" (signals S2 or S3 in FIG. 4), then the substrate area controlled by the triggers has to be considered defective (for example missing edge, crease) and this may be represented by the Boolean operation $S4 \wedge \overline{S2} \wedge \overline{S3} = \neg(\overline{S4} \wedge S2 \wedge S3)$ Therefore, the system provides four detected change signals with two detections carried out in places potentially having a defect between two triggers placed where the substrate has most probably no defect.

By knowing the speed of transport of the substrate, the positions and relative distances between triggers and checkpoints in the direction of transport of the substrate 1, it is easy to calculate the timing of the detection signals for the triggers 2, 5 and the checkpoints 3, 4, i.e. once the first trigger has detected the leading edge 6 of the substrate, after how much time first checkpoint 3 and second checkpoint 4 have to detect said leading edge 6 if the substrate has no defect, and then when the second trigger has to detect said leading edge 6. Accordingly, the detection of both checkpoint signals between the detection of the trigger signals allows controlling the integrity of the substrate 1.

As indicated above, in the process according to the invention, it is possible to carry out the integrity check either on the leading edge of a substrate or on the trailing edge, or even on both edges with the same detection device.

An example of a control device for carrying out the process according to the invention is described with reference to FIGS. 2 and 5.

This device comprises at least three detectors, one trigger 2 and two checkpoints 3, 4, preferably four detectors 2 to 5 as shown in FIG. 2, arranged to detect the leading edge 6 or trailing edge 7 of a substrate 1 at selected points, as explained above with reference to the process of the invention. For example, a detector is used as the first trigger 2, a detector as first checkpoint 3 detector, a detector as second checkpoint 4 detector and a detector as second trigger 5.

All detectors are placed at appropriate distances between them, the sum of the relative distance being sufficient to properly carry out the process. The distances may be adjusted depending on the size of the substrate being controlled. All detectors are connected to a circuit 14 which is able and programmed to collect the information about the respective detection made by the detectors, use this information to decide whether or not the control of a given substrate has given the proper sequence of detection, and generate an error message of necessary.

The detectors are preferably optical detectors made of LED or other equivalent light emitter, which are known in the art. They each further comprise a detecting element which is able to detect a change in the reflection of the light emitted by the diodes, due to a modification of the background, for example when the background changes from a dark background to a clear background (detection of the leading edge of a substrate) or from a clear background to a dark background (detection of the trailing edge of a substrate), that is absence of substrate such a paper and presence of substrate.

Figure 5:
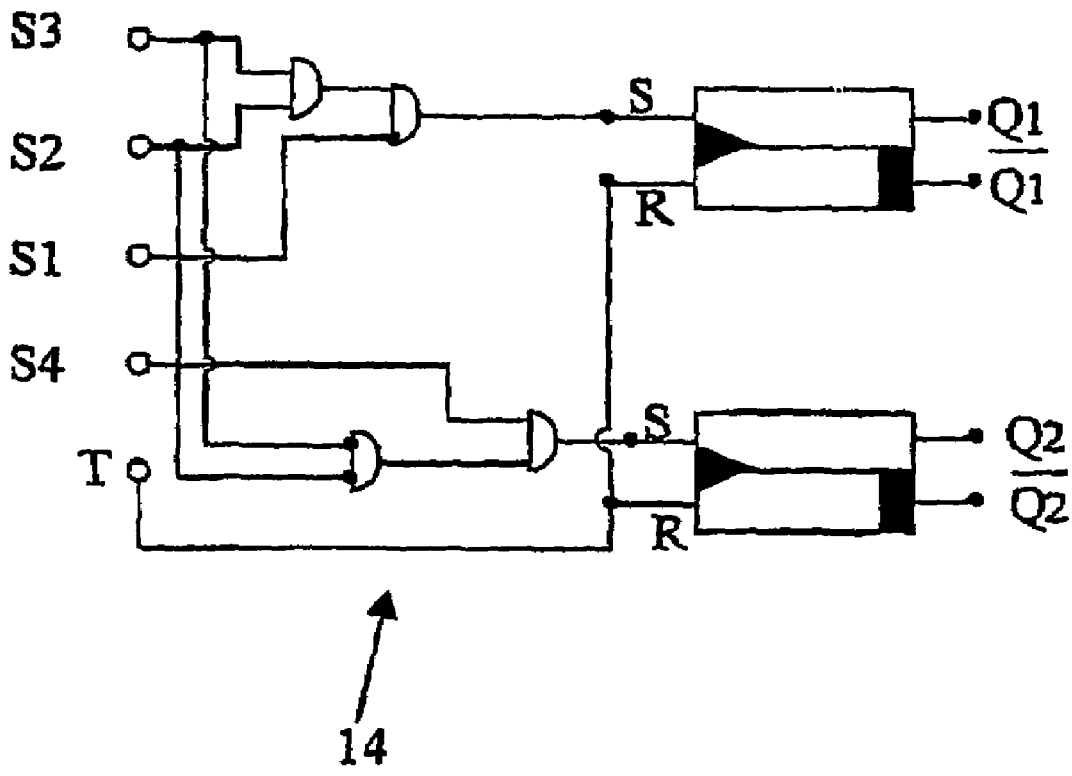
FIG. 5 shows a circuit suitable for carrying out the detection.

A circuit 14 which can be used in the method according to the invention is represented in FIG. 5 of the application. Derived from the above-mentioned boolean operations, the circuit given as a logic circuit fulfills the needed function. Since the detection of a leading edge is the Boolean negation of the trailing edge the output of the RS-flip-flop Q1,Q2 will give the result for the integrity of the trailing edge whereas $\overline{Q1}$,$\overline{Q2}$ will give the result for the leading edge.

A simple trigger T can be used to reset the device when necessary.

A machine, for example a printing machine in the field of securities, may comprise at least one control device according the invention. Such a control device may also be placed at several positions of the machine in order to control the integrity of the substrate, for example a sheet of paper, at different stages of the printing process.

The embodiments of the invention are given by way of example and are not to be considered as limiting on the scope of the claims.

The invention claimed is:

1. Process for controlling the integrity of planar substrates, such as sheets of paper, characterised by the following steps:

providing a first trigger at a selected first location along the direction of displacement of the substrate for detecting the passage of an edge of the substrate at said first location;

providing a second trigger at a selected second location disposed downstream of said first trigger along the direction of displacement of the substrate for detecting the passage of an edge of the substrate at said second location;

providing at least a first checkpoint detector at a selected third location disposed between said first and second triggers along the direction of displacement of the substrate, said at least first checkpoint detector being adapted to detect the passage of said edge of the substrate at a selected place along said edge which is different than the place at which said first and second triggers are adapted to detect the passage of said edge;

detecting the passage of said edge of the substrate at said selected locations by means of said first trigger, said at least first checkpoint detector and said second trigger;

controlling whether the passage of said edge of the substrate was detected by said at least first checkpoint detector after detection by said first trigger and before detection by said second trigger; and generating an integrity check failed message in case the passage of said edge of the substrate was not detected by said at least first checkpoint detector after detection by said first trigger and before detection by said second trigger.

2. A process as claimed in claim 1, wherein two or more checkpoint detectors are provided at selected locations between said first and second triggers along the direction of displacement of the substrate, each of said checkpoint detectors being adapted to detect the passage of said edge of the substrate at selected places along said edge which are different that the place at which said first and second triggers are adapted to detect the passage of said edge.

3. A process as claimed in claim 2, wherein the integrity check failed message is generated in case the passage of said edge of the substrate was not detected by one of said checkpoint detectors after detection by said first trigger and before detection by said second trigger.

4. A process as claimed in claim 2, wherein two checkpoint detectors are located close to the corners of said substrate.

5. A process as claimed in claim 1, wherein said edge is the leading edge and/or the trailing edge of the substrate.

6. A process as claimed in claim 1, wherein said detection is made by optical means.

7. A control device for controlling the integrity of planar substrates, such as sheets of papers, said device being characterised in that it comprises:

a first trigger arranged at a selected first location along the direction of displacement of the substrate for detecting the passage of an edge of the substrate at said first location;

a second trigger arranged at a selected second location disposed downstream of said first trigger along the direction of displacement of the substrate for detecting the passage of an edge of the substrate at said second location;

at least a first checkpoint detector arranged at a selected third location disposed between said first and second triggers along the direction of displacement of the substrate, said at least first checkpoint detector being adapted to detect the passage of said edge of the substrate at a selected place along said edge which is different than the place at which said first and second triggers are adapted to detect the passage of said edge; and a computer element adapted to control whether the passage of said edge of the substrate was detected by said at least first checkpoint detector after detection by said first trigger and before detection by said second trigger.

8. A control device as claimed in claim 7, characterised in that it further comprises another checkpoint detector arranged at a selected fourth location between said first and second triggers along the direction of displacement of a substrate and which is adapted to detect the passage of said edge at another place along said edge.

9. A control device as claimed in claim 7, characterised in that said triggers and checkpoint detectors are optical detectors.

10. A control device as claimed in claim 7, characterised in that said triggers and checkpoint detectors comprise light emitting diodes.

11. A machine characterised by at least one control device according to claim 7.

* * * * *

UNITED STATES PATENT AND TRADEMARK OFFICE

CERTIFICATE OF CORRECTION

PATENT NO. : 7,385,702 B2
APPLICATION NO. : 10/537122
DATED : June 10, 2008
INVENTOR(S) : Johannes Georg Schaede It is certified that error appears in the above-identified patent and that said Letters Patent is hereby corrected as shown below:

Column 5
Line 30, delete “emitter” and insert therefor -- emitters --.

Signed and Sealed this

Sixteenth Day of September, 2008

JON W. DUDAS
*Director of the United States Patent and Trademark Office*